United States Patent [19]

Sorensen

[11] 4,422,299

[45] Dec. 27, 1983

[54] FLASH SYSTEM POWER GENERATOR

[76] Inventor: George C. Sorensen, 589 SE. 4th St., Ontario, Oreg. 97914

[21] Appl. No.: 223,417

[22] Filed: Jan. 8, 1981

Related U.S. Application Data

[63] Continuation-in-part of Ser. No. 76,435, Sep. 17, 1979, abandoned.

[51] Int. Cl.[3] ..... F01K 19/00

[52] U.S. Cl. ..... 60/681; 60/669; 122/250 R

[58] Field of Search ..... 60/669, 681, 689; 122/249, 250 R, 235 K

[56] References Cited

U.S. PATENT DOCUMENTS

| | | | |
|---|---|---|---|
| 2,621,635 | 12/1952 | Joosten | 122/250 R |
| 3,572,037 | 3/1971 | Sorensen | 60/39.5 X |
| 4,319,458 | 3/1982 | Berkley | 60/670 X |

FOREIGN PATENT DOCUMENTS

| | | | |
|---|---|---|---|
| 133050 | 5/1920 | United Kingdom | 60/669 |

*Primary Examiner*—Allen M. Ostrager
*Assistant Examiner*—Stephen F. Husar

[57] ABSTRACT

A light weight self-cleaning safety flash system power generator is devised wherein: a plenum is formed enclosing a low pressurized combustion process, a light weight low pressure heat exchanger capable of safely receiving a fluid at low pressure for massive latent heat absorption; at nearly its boiling temperature this fluid is forced into the upper zone of the combustion process in at least a single safety high pressure tube for providing a safe high pressure heat exchanger formed as convolutions around the combustion zone always leading its fluid in a downward flow manner providing a cleaning and entraining action without leaving any pockets of sediment and always absorbing heat energy and finally reaching a throttle valve for flashing its energy as steam or gas pressure into its engine; the insignificant pollution passing harmlessly much as the carbon and ash pass through the internal combustion engine. A condensing system is provided for acquiring the combustion compounded condensate for recirculating through the system providing the self-cleaning action.

2 Claims, 1 Drawing Figure

20'
P
26
34
19
1
36
21
P
VD
28P
18
37
V
REL
62
VT60
60 VT
TURBINE
ENGINE
35
39
38
33
CP
REG
40
63
VAPOR
WATER OR AIR COOLED
CONDENSATE
TO
PUMP 21
CONDENSER 56
HOT AIR TO BLOWER 26

FLASH SYSTEM POWER GENERATOR

CROSS REFERENCES TO RELATED APPLICATIONS

This application is a continuation in part of my application filed Sept. 17, 1979, Ser. No. 076435, now abandoned. I propose my engines U.S. Pat. Nos. 3,728,858 and 3,572,037 be used with this present system.

TECHNICAL FIELD OF THE INVENTION

This invention relates generally to a power system wherein: a quantity of fluid is held separate for safety reasons and heated in a low pressure light weight heat exchanger having massive latent heat absorption capabilities; then for providing a very safe, high pressure light weight heat exchanger the fluid is forced at high pressure into at least a single high pressure tube reaching upwardly into the high heat zone where the tube turns in a downward manner formed as convolutions around the combustion zone for causing a self cleaning action; as the fluid moving downwardly always increasing in heat energy is lead to a throttle valve where it is flashed as gas or steam pressure into such an engine as those noted above.

BACKGROUND OF THE INVENTION

Description of Prior Art

For over two centuries fluid has been heated in what has been called a "Boiler". This fluid has been heated in its entire mass and changed to steam pressure which was lead from a high part of the boiler or a steam dome for use in an engine or other purpose. While this system provided a steam at moderate pressure and used very successfully in engines and turbines, but with very low efficiency because of heat losses from radiation, condensation, low heat from poor heat utilization, through boiler shell, plumbing and engine parts; always suffering a severe loss of energy because of the necessity of periodically blowing, with much boiler energized fluid, the sediment and sludge which accumulated in the bottom, walls and tubing, from the bottom of the boiler. A boiler having this mass of pressurized and energized fluid inside always caused a very serious danger of a "blockbuster" type explosion, in the event of accident, which necessitated a very heavy safety factor being built into such an entire structure. Entire power plants, boats and ocean liners have been blown up because of these explosions causing great loss of life property, regardless of the heavy structures, because of unexpected accidents, such as bombs torpedoes, collisions and the like. The terrific damage is caused by the sudden release of the mass of accumulated energy flashing to steam.

SUMMARY

A forced test explosion in a single tube such as I propose, causes only minor damage, because the mass of high pressure energy may be limited by varying the amount of heat and fluid used to satisfy only the power demands. No accumulation of sludge is formed because the rapid flow of fluid in the downward manner, as described, washes and continually cleans the system of the little sediment or sludge that might form and flashes it through the engine without damage, much as the carbon and ash is wasted through an internal combustion engine. The combustion compounded condensate acquired is an excellent medium for cleansing and washing the system as described.

A primary object of the invention is to provide a light weight power generator having excellent safety factors. Another object of the invention is to provide a power generator having self cleaning features, without wasting energized fluid through the conventional, "blowdown". Yet another object of the invention is the provision of a plenum enclosing most of the system for conserving and impart-pressurized heat of combustion to the heat exchangers and finally to be injected into such engines as I suggested in the foregoing, where the products of combustion further compressed, comingled with the expansive medium and led as exhaust to a condenser at reduced pressure for providing the combustion compounded condensate for recirculation as the cleaning medium as described in the foregoing.

BRIEF DESCRIPTION OF THE DRAWING

Referring to the drawing

BEST MODE FOR CARRYING OUT THE INVENTION

Figure 1:
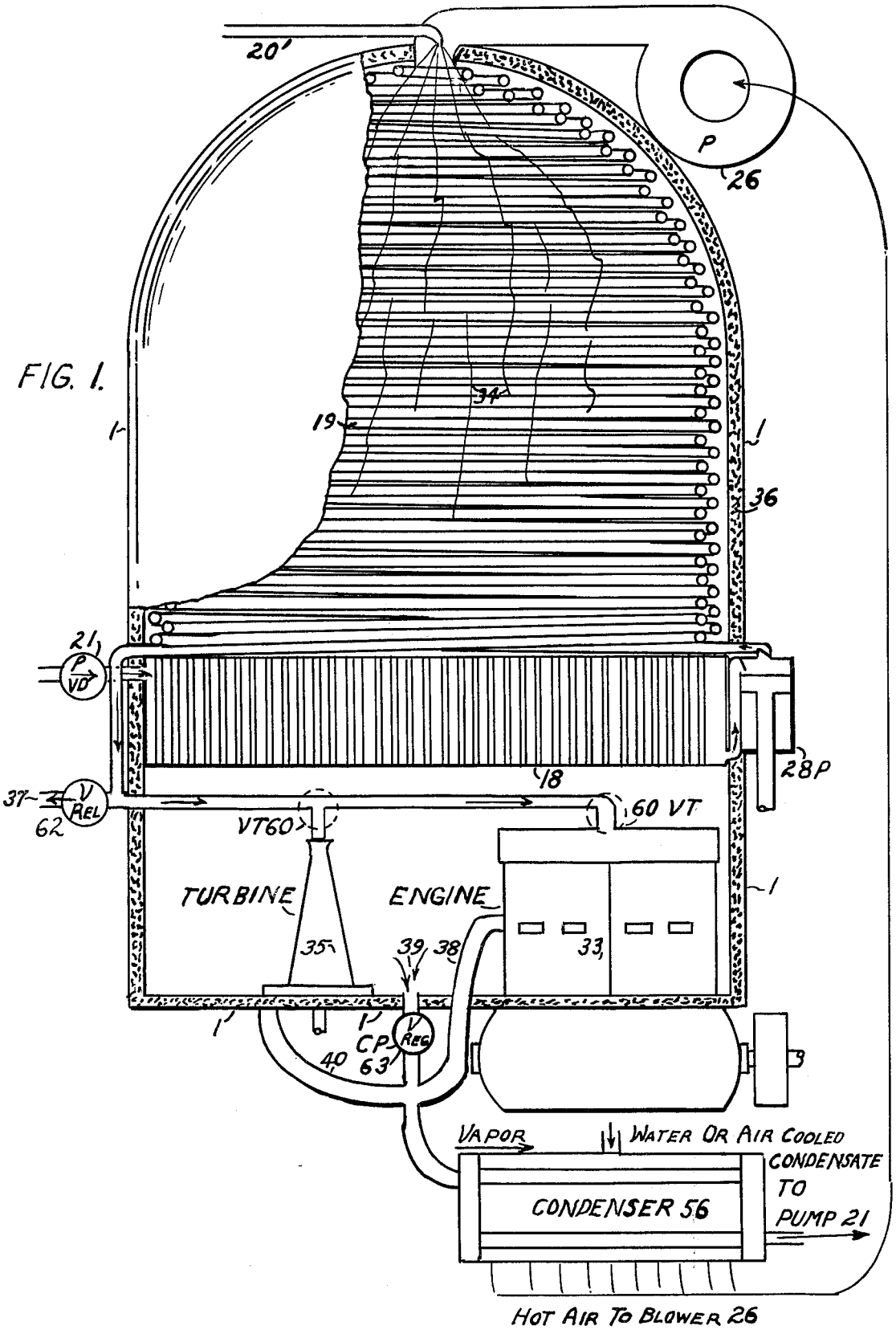
FIG. 1 is a combined fragmentary and sectional view illustrating an assembly of the various parts, comprising the invention. It must be noticed, for instance, that the arrangement of the parts could be changed to accomodate the type of fuel to be used; without changing the spirit of the system. As the drawing indicates, this system would serve as a liquid or gas fueled furnace while a coal, coke or other solid fuel furnace would require an under feed auger forced fueling system having a cone type burner; not illustrated but familar to the art. The insulated plenum would need to be formed horizontally.

In the drawing the number 1 indicates an insulated plenum having a reflecting insulation 36 completely enclosing a pressurized combustion process 34, a light weight low pressure heat exchanger 18 having great heat absorbing capabilities is fed at light pressure with a variable delivery pump 21 with a fluid such as water mixture, where it is heated to nearly the boiling temperature whereupon the fluid is forced by high pressure force pump 28P into an included high strength tube leading the fluid upwardly to the upper heat zone where the tube 19 then turns downwardly formed as many convolutions around the combustion process 34 receiving further heat absorption, the tube continues downwardly without forming any pockets for sediment accumulation to a relief valve 62 for emergency relief and to a throttle valve 60 for flashing highly energized fluid as steam or gas pressure into engines 33 or 35. The exhaust from these engines is led from the plenum 1 to a condenser 56 for condensing mingling steam and products of combustion for providing the combustion compounded condensate for recirculation through the system as cleaner.

I claim:

1. A safety self-cleaning flash system power generator consisting of; a plenum chamber, a combustor situated in the upper portion of said plenum chamber, said combustor having a blower for providing pressurized air and means for supplying fuel for combustion with the pressurized air, a low pressure pump for circulating a working fluid, a low pressure heat exchanger situated in the lower portion of said plenum chamber in heat exchange communication with the combustion gases from said combustor, said low pressure pump circulating the working fluid through said low pressure heat exchanger, a high pressure pump in fluid communication with said low pressure heat exchanger for pressurizing the working fluid which has been heated to near its boiling point in said low pressure heat exchanger, said pressurized working fluid being introduced to a high pressure heat exchanger, said high pressure heat exchanger leading said pressurized working fluid in an upward path towards said combustor, said high pressure heat exchanger consisting of at least a single high pressure tube which upon reaching the upper end of said plenum chamber proceeds in a winding downward path causing said working fluid to continuously clean said high pressure heat exchanger, said working fluid being flashed by means of a throttle valve upon reaching the end of said winding downward path, an engine situated in the lower portion of said plenum chamber receiving said flashed working fluid to generate power and exhausting said working fluid to a condenser, said condenser also receiving the combustion gases from said combustor so that the combustion gases and exhausted working fluid are condensed for recirculation to the low pressure pump.

2. A safety self-cleaning flash system power generator as in claim 1; wherein said condenser is an air-cooled condenser and the air heated in said air-cooled condenser is supplied to said blower for combustion with the fuel in said combustor.

* * * * *